US005729942A

United States Patent [19]

Moore, Jr.

[11] Patent Number: 5,729,942

[45] Date of Patent: Mar. 24, 1998

[54] WALL ASSEMBLY OF FOAM BLOCKS WITH INTERNAL CONCRETE GRID AND INTEGRAL WINDOW FRAME

[76] Inventor: Franklin Moore, Jr., 460 Harmon Ave., PO Box 375, Lebanon, Ohio 45036

[21] Appl. No.: 630,746

[22] Filed: Apr. 10, 1996

[51] Int. Cl.[6] ..... E04B 2/64; E06B 1/26

[52] U.S. Cl. ..... 52/437; 52/204.2; 52/204.53; 52/211; 52/212; 52/438

[58] Field of Search ..... 52/215, 309.12, 52/432, 437, 438, 204.2, 439, 436, 431, 212, 211, 204.54, 204.53, 745.16, 745.15

[56] References Cited

U.S. PATENT DOCUMENTS

| | | | |
|---|---|---|---|
| 2,326,549 | 8/1943 | Miller | 52/211 |
| 3,769,769 | 11/1973 | Kohl | 52/212 |
| 4,223,501 | 9/1980 | DeLozier . | |
| 4,246,731 | 1/1981 | Miro | 52/204.53 |
| 4,319,440 | 3/1982 | Rassias et al. | 52/438 |
| 4,430,831 | 2/1984 | Kemp | 52/127.3 X |
| 4,589,624 | 5/1986 | Jones | 52/215 X |
| 5,123,222 | 6/1992 | Guariello et al. | 52/439 X |
| 5,311,718 | 5/1994 | Trousilek | 52/425 |
| 5,465,542 | 11/1995 | Terry | 52/431 X |

OTHER PUBLICATIONS

1994 –Golden Planet Holdings Inc Window & Rolling Shutter.

1994 –Golden Planet Holdings Inc Pocket–Window Detail.

*Primary Examiner*—Wynn E. Wood

*Assistant Examiner*—Timothy B. Kang

*Attorney, Agent, or Firm*—Jacox, Meckstroth & Jenkins

[57] ABSTRACT

A stack of expanded foam blocks form a wall and define interconnected vertical and horizontal internal cavities which receive reinforcing rods, and concrete is pumped into the cavities to form an internal grid of reinforced concrete posts and beams. A set of opposing frame sections or shells clamp the blocks around a rough window or door opening and cooperate to define a frame cavity which receives the concrete pumped into the internal cavities to form a concrete window or door frame integrally connected to the concrete grid. In one embodiment, the opposing window frame shells remain with the wall and form a smooth seat for a window unit, and in another embodiment, the window or door shells are removed from the wall to form a concrete seat for the window or door unit.

13 Claims, 1 Drawing Sheet

WALL ASSEMBLY OF FOAM BLOCKS WITH INTERNAL CONCRETE GRID AND INTEGRAL WINDOW FRAME

BACKGROUND OF THE INVENTION

This invention relates to a building wall formed by a stack of stay-in-place expanded plastic foam blocks defining a grid of interconnected vertical and horizontal cavities which receive reinforcing rods and concrete. In such a wall construction, it is frequently desirable to provide for a rigid window and/or door frame which can withstand substantial wind forces such as commonly produced by a hurricane and which are easy to install, low in cost and produce a visually attractive architectural appearance.

SUMMARY OF THE INVENTION

In accordance with one embodiment of the invention, a vertical wall is formed by stacking a plurality of elongated rigid foam plastic blocks which cooperatively define a grid of interconnected vertical and horizontal internal passages or cavities in which steel reinforcing rods are positioned. The foam blocks define rough window and/or door openings, and a set of opposing molded or formed frame sections or shells clamp the foam blocks around each rough opening. The shells cooperate with the blocks to define a cavity extending around each set of frame sections or shells. When concrete is poured or pumped into the vertical cavities within the foam blocks, the concrete also fills the horizontal cavities and frame cavities to form concrete window and/or door frames each of which is integrally connected to the grid of internal reinforced concrete posts and beams within the cavities. Each set of frame sections or shells may remain with the wall to define a smooth and decorative frame and seat for receiving a window or door unit. As an alternative, each set of opposing frame sections or shells may be removed to expose a concrete frame and seat and to be reused as a mold for forming another window and/or door opening.

Other features and advantages of the invention will be apparent from the following description, the accompanying drawing and the appended claims.

DESCRIPTION OF THE PREFERRED EMBODIMENTS

Figure 1:
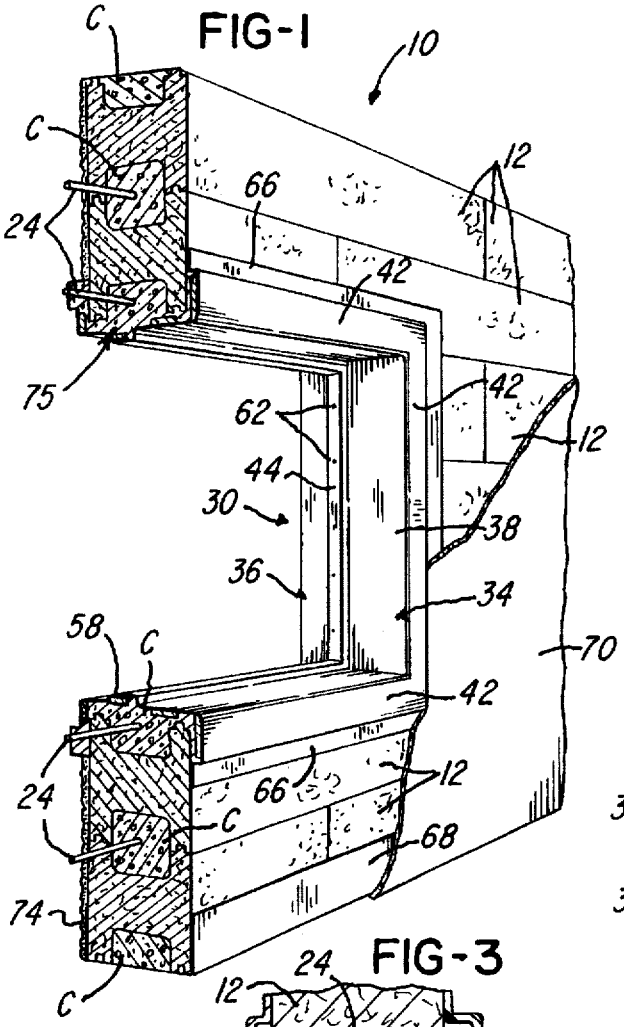
FIG. 1 is a fragmentary perspective view of a wall assembly and integral window frame constructed in accordance with the invention.

FIG. 1 illustrates a vertical wall assembly 10 formed by a stack of stay-in-place modular forms or elongated blocks 12 which are preferably molded of an expanded rigid plastics foam material such as expanded rigid polystyrene. Each of the blocks 12 defines upper and lower longitudinally extending horizontal cavities 14 and a plurality of longitudinally space vertical cavities 16 which intersects the horizontal cavities 14. Each of the foam blocks 12 also has an upper surface formed by a pair of upwardly projecting and longitudinally extending tongues or ribs 19 and bottom surface which defines longitudinally extending grooves 22. The ribs 19 continue downwardly along one end of each block 12, and the grooves 22 extend upwardly along the opposite end of each block 12.

Figure 2:
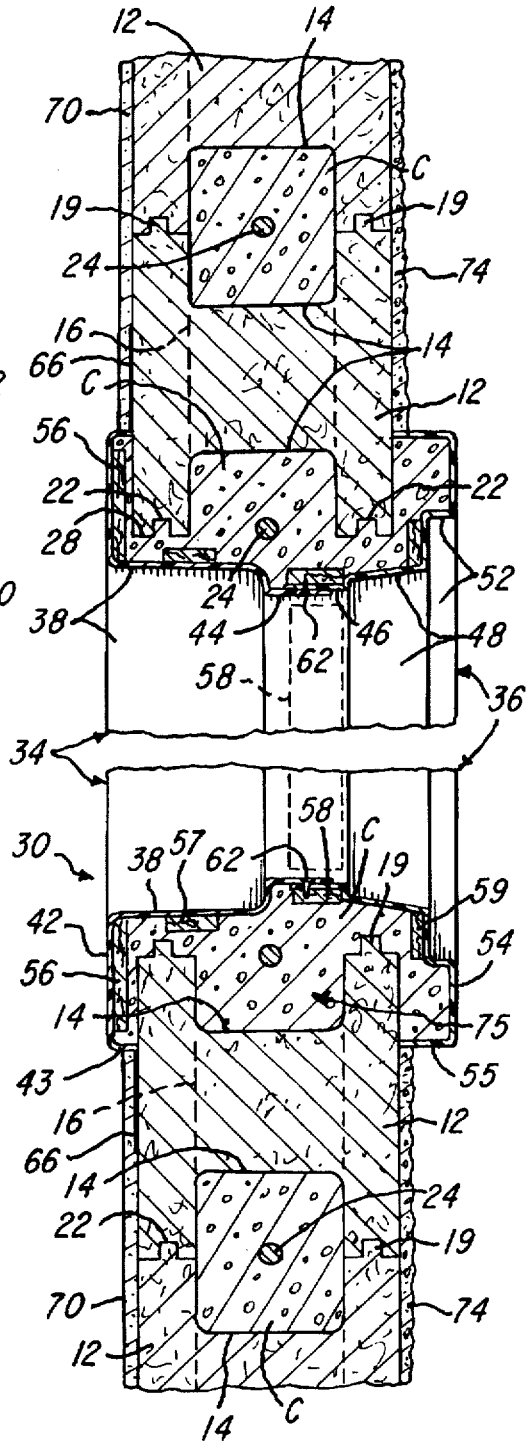
FIG. 2 is an enlarged vertical section taken through the wall assembly and window frame of FIG. 1.

As apparent from FIGS. 1 and 2, when the blocks 12 are stacked, the ribs 19 of each block project into the opposing grooves 22 of each adjacent block. Horizontal steel reinforcing rods 24 are positioned within the center of the opposing cavities 14 which cooperate to define a cavity having generally a square cross-sectional configuration. Similar reinforcing rods 24 are positioned within the center of the vertical cavities 16 and are preferably tied to the horizontal rods 24 at the crossings. When concrete C is poured or pumped into the vertical passages 16 defined within the blocks 12 along the top of the wall, the concrete flows downwardly and laterally or horizontally into the cavities 14 and around all of the reinforcing rods 24 to form a reinforced concrete X-Y grid structure within the wall 10.

In accordance with the present invention, some of the foam blocks 12 forming the wall 10 are omitted and/or cut to define a rough rectangular window opening 28 within the wall 10. A frame 30 is positioned within the opening, and includes a set of opposing rectangular frame sections or shells including an inner frame section or shell 34 and an outer frame section or shell 36 each of which is preferably formed or molded of fiberglass in a conventional manner with mats of glass fibers and suitable resin and has a generally uniform wall thickness. However, the frame sections may also be vacuum formed or extruded of thermoplastics material, formed sheet metal, roto-molded or reaction injection molded plastics. The inner frame section 34 includes a rectangular frame-like panel portion 38 which integrally connects with a surrounding rectangular planar flange portion 42 with a surrounding peripheral return lip portion 43. The inner section or shell 34 also includes a rectangular flange or seat portion 44 which overlaps an inwardly projecting rectangular flange or seat portion 46 of the outer frame section or shell 36. The flange portion 46 integrally connects with a rectangular frame-like panel portion 48 which tapers outwardly and forms a sill surface along the bottom of the panel portion 48. The panel portion 48 integrally connects with a step portion 52 from which extends a planar flange portion 54 and a return flange or lip portion 55. The step portion 52 forms a seat for receiving a hurricane shutter (not shown) when the wall 10 is constructed in an area exposed to high winds or hurricanes.

As shown in FIG. 2, strips 56,57,58 and 59 of wood are cemented to the outer surfaces of each frame section or shell 34 and 36 to provide for attaching accessories to the shells with the use of screws. The wood strips 58 also receive a series of screws 62 which extend through holes within the overlapping edge portions or flanges 44 and 46 and into the wood strips 58 to secure the shells 34 and 36 together with the shells clamping opposite sides of the foam blocks 12 around the window opening.

As shown in FIG. 1, thin flat sheet metal bands or strips 66 surround the inner frame section 34 and project outwardly from the return flange 43. The strips are adhesively bonded to the outer surfaces of the foam blocks 12. Another flat sheet metal band or strip 68 (FIG. 1) is attached by adhesive to the lower course of blocks 12 along the floor. As also shown in FIG. 1, sheets of drywall 70 are attached to the inner surfaces of the foam blocks 12 by adhesive and to the sheet metal strips 66 and 68 by drywall screws (not shown). The outer surfaces of the foam blocks 12 forming the wall 10 may be covered with an exterior material such as stucco 74 which bonds to the blocks 12.

As apparent from FIGS. 1 and 2, when concrete C is poured or pumped into the vertical passages 16 spaced along the length of each foam block 12 and extending to the top of the wall, the concrete C flows into the horizontal cavities 14 and also flows into the frame-like cavity extending around or surrounding the frame sections or shells 34 and 36 clamped to the blocks 12. As a result, the mating and opposing shells 34 and 36 are backed up by concrete C which integrally connects to the concrete C within the horizontal cavities 14 and vertical cavities 16 and forms a concrete frame 75. This connection produces an extremely rigid window frame 30, and a conventional window unit (not shown) such as a double hung window, sliding window, casement window or picture window, may be installed within the frame 30 preferably in the area of the overlapping inner edge portions or flanges 44 and 46.

The window unit may be secured by fasteners or screws which are threaded into the embedded wood strips 58 which extend around the window unit. As apparent from FIG. 2, the concrete C surrounding the window frame 30 completely fills all of the voids defined between the frame 30 and the surrounding foam blocks 12, and both vertical and horizontal reinforcing rods 24 are preferably located within the concrete surrounding the frame 30. To assure that the concrete fills all of the voids, the shells 34 and 36 may be tapped or vibrated lightly during the pouring operation.

Figure 3:
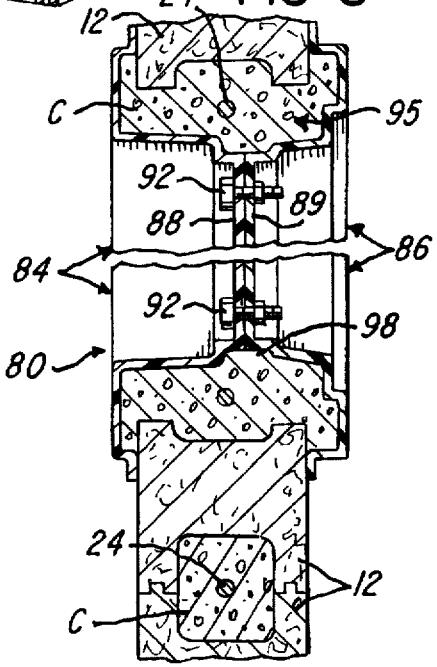
FIG. 3 is a fragmentary vertical section similar to FIG. 2 and showing another embodiment of the invention.

Referring to FIG. 3, a window frame 80 includes a set of removable fiberglass frame sections or shells 84 and 86 which are constructed similar to the shells 34 and 36 with similar components except that the shells 84 and 86 have inwardly extending or projecting abutting flanges or walls 88 and 89, respectively. The walls 88 and 89 are secured together by a series of bolts 92 in order to clamp the shells 84 and 86 to the wall blocks 12. When the vertical and horizontal cavities 14 and 16 within the wall blocks 12 are filled with concrete C, as described above, the concrete flows into the frame-like cavity surrounding the frame shells 84 and 86 and forms a rectangular shaped concrete window frame 95. After the concrete sets, the bolts 92 are removed, and the frame sections or shells 84 and 86 are separated from the blocks 12 to expose the concrete window frame 95 within the assembled wall blocks 12. Thus the frame shells 84 and 86 may be reused as molds for forming numerous integrally connected concrete window frames within a reinforced foam block wall. Preferably, the shells 84 and 86 have a heavier wall thickness than the shells 34 and 36 so that the shells 84 and 86 may be used over and over as forms for producing concrete window frames 95. After a set of window shells 84 and 86 are removed, a window unit is installed within the inwardly projecting frame-like rib or seat 98 formed by the concrete.

From the drawing and the above description, it is apparent that a wall assembly 10, including a stack of stay-in-place form blocks 12 and a concrete window frame 75 or 95 integrally connected to the internal grid of vertical concrete posts and horizontal concrete beams, provides for a very rigid wall and window frame assembly. The assembly is capable of withstanding substantial wind forces as commonly produced by a hurricane. If it is desired to have a smooth window frame 30, the frame sections or shells 34 and 36 are constructed to remain as part of the wall assembly. However, in a wall assembly of more economical construction, an integrally connected concrete window frame 95 may be formed by using the removable frame sections or shells 84 and 86, as described above in connection with FIG. 3. It is also apparent that integrally connected concrete doorway frames may be produced in the same manner as described above for the concrete window frames. The lower portions or rails of the door frame sections or shells would rest on the floor.

While the wall assemblies herein described and their methods of construction constitute preferred embodiments of the invention, it is to be understood that the invention is not limited to the precise wall assemblies and methods described, and that changes may be made therein without departing from the scope and spirit of the invention as defined in the appended claims.

The invention having thus been described, the following is claimed:

1. In a wall assembly comprising a stack of modular form blocks having opposite inner and outer vertical side surfaces and defining internal cavities, a concrete material extending within said internal cavities and forming concrete posts and beams within said blocks, said blocks defining a rough opening within said wall assembly, a rigid frame disposed within said opening, said frame including an inner frame section and an opposing outer frame section connected together, said frame sections having outwardly projecting peripheral flange portions overlying the corresponding said side surfaces of said blocks defining said opening, said overlying flange portion of said outer frame section spaced laterally outwardly from said outer side surfaces of said blocks, said connected frame sections cooperating with said blocks around said opening to define a frame cavity extending continuously around said frame with said frame cavity connected to said internal cavities, said frame cavity extending laterally outwardly of said outer side surfaces of said blocks and within said overlying flange portion of said outer frame section, and said concrete material extends from said internal cavities into said frame cavity to form a rigid concrete frame extending continuously around said opening with said concrete frame overlying said outer side surfaces of said blocks and integrally connected to said concrete posts and beams within said blocks.

2. A wall assembly as defined in claim 1 wherein said form blocks comprise an expanded rigid plastics foam material, and said frame sections comprise a rigid plastics material.

3. A wall assembly as defined in claim 1 wherein said frame sections include horizontally overlapping and connected inner flange portions forming a center portion of said frame.

4. A wall assembly as defined in claim 1 and including a plurality of releasable fasteners securing said frame sections together and providing for removing said frame sections from said form blocks to expose said concrete frame.

5. A wall assembly as defined in claim 1 wherein said outer frame section defines a peripherally extending shoulder adapted to support a hurricane shutter on said outer frame section.

6. In a wall assembly comprising a stack of modular form blocks having opposite inner and outer vertical side surfaces and defining internal cavities, a concrete material extending within said internal cavities and forming concrete posts and beams within said blocks, said blocks defining a rough opening within said wall assembly, a rigid frame disposed within said opening, said frame including an inner frame section and an opposing outer frame section connected together, said frame sections having outwardly projecting peripheral flange portions overlying the corresponding said side surfaces of said blocks defining said opening, said overlying flange portion of each said frame section spaced laterally outwardly from the corresponding said side surfaces of said blocks, said connected frame sections cooperating with said blocks around said opening to define a frame cavity extending continuously around said frame with said frame cavity connected to said internal cavities, said frame cavity extending laterally outwardly of said inner and outer side surfaces of said blocks and within said overlying flange portions of said frame sections, and said concrete material extends from said internal cavities into said frame cavity to form a rigid concrete frame extending continuously around said opening with said concrete frame overlying said inner and outer side surfaces of said blocks and integrally connected to said concrete posts and beams within said blocks.

7. A wall assembly as defined in claim 6 wherein said form blocks comprise an expanded rigid plastics foam material, and said frame sections comprise a rigid plastics material.

8. A wall assembly as defined in claim 6 wherein said frame sections include horizontally overlapping and connected inner flange portions forming a center portion of said frame.

9. A wall assembly as defined in claim 6 and including a plurality of releasable fasteners securing said frame sections together and providing for removing said frame sections from said form blocks to expose a settable material within said frame.

10. A wall assembly as defined in claim 6 wherein said outer frame section defines a peripherally extending shoulder adapted to support a hurricane shutter on said outer frame section.

11. In a wall assembly comprising a stack of modular form blocks having opposite inner and outer vertical side surfaces and defining internal cavities, a concrete material extending within said internal cavities and forming concrete posts and beams within said blocks, said blocks defining a rough opening within said wall assembly, a rigid frame disposed within said opening, said frame including a molded fiberglass inner frame section and an opposing molded fiberglass outer frame section connected together, said frame sections having outwardly projecting peripheral flange portions overlying the corresponding said side surfaces of said blocks defining said opening, said overlying flange portion of said inner and outer frame sections spaced laterally outwardly from said inner and outer side surfaces of said blocks and having peripheral return lip portions, said connected frame sections cooperating with said blocks around said opening to define a frame cavity extending continuously around said frame with said frame cavity connected to said internal cavities, said frame cavity extending laterally outwardly of said inner and outer side surfaces of said blocks and within said overlying flange portions of said inner and outer frame sections, and said concrete material extends from said internal cavities into said frame cavity to form a rigid concrete frame extending continuously around said opening with said concrete frame overlying said inner and outer side surfaces of said blocks and integrally connected to said concrete posts and beams within said blocks.

12. A wall assembly as defined in claim 11 and including a series of wood strips attached to said frame sections and embedded in said concrete frame.

13. A wall assembly as defined in claim 11 wherein said outer frame section defines a peripherally extending shoulder adapted to support a hurricane shutter on said outer frame section.

* * * * *